US006228239B1

(12) United States Patent
Manalastas et al.

(10) Patent No.: US 6,228,239 B1
(45) Date of Patent: May 8, 2001

(54) CRUDE OIL DESALTING METHOD

(75) Inventors: Pacifico V. Manalastas, Edison; Ramesh Varadaraj, Flemington; David W. Savage, Lebanon; Guido Sartori, Annadale; Ramesh R. Hemrajani, Millington; Cornelius Hendrick Brons, Washington, all of NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/258,620

(22) Filed: Feb. 26, 1999

(51) Int. Cl.[7] ..... B01D 17/06; B01D 17/04

(52) U.S. Cl. ..... 204/567; 204/569; 210/708; 210/748; 516/183; 208/188

(58) Field of Search ..... 516/181, 183, 516/FOR 141, FOR 163; 210/708, 748; 204/567, 569; 208/188

(56) References Cited

U.S. PATENT DOCUMENTS

| | | | | |
|---|---|---|---|---|
| 1,695,251 | | 12/1928 | Kalichevsky | 208/278 |
| 2,028,335 | | 1/1936 | Kalichevsky | 208/330 |
| 2,068,979 | | 1/1937 | Fisher | 208/348 |
| 2,071,862 | | 2/1937 | Fisher | 556/106 |
| 2,229,995 | | 1/1941 | Yabroff et al. | 208/231 |
| 2,770,580 | | 11/1956 | Honeycutt et al. | 208/263 |
| 2,789,081 | | 4/1957 | Mills | 208/253 |
| 2,795,532 | | 6/1957 | Honeycutt | 208/263 |
| 3,806,437 | | 4/1974 | Franse et al. | 204/567 |
| 3,847,774 | | 11/1974 | Jarrell | 204/567 |
| 3,893,918 | * | 7/1975 | Favret, Jr. | 210/104 |
| 4,199,440 | | 4/1980 | Verachtert | 208/230 |
| 4,300,995 | | 11/1981 | Liotta | 208/403 |
| 4,407,706 | * | 10/1983 | Merchant, Jr. et al. | 210/708 |
| 4,416,754 | * | 11/1983 | Merchant, Jr. et al. | 516/183 |
| 4,551,239 | * | 11/1985 | Merchant et al. | 516/183 |
| 4,702,815 | * | 10/1987 | Prestridge et al. | 204/673 |
| 4,720,341 | * | 1/1988 | Arnold | 210/262 |
| 4,737,265 | * | 4/1988 | Merchant, Jr. et al. | 208/188 |
| 5,182,013 | | 1/1993 | Petersen et al. | 208/348 |
| 5,256,305 | * | 10/1993 | Hart | 516/181 |
| 5,672,739 | * | 9/1997 | Varadaraj et al. | 562/106 |
| 5,693,257 | * | 12/1997 | Hart | 516/183 |
| 5,989,436 | * | 11/1999 | Suzumura et al. | 210/708 |
| 6,030,523 | * | 2/2000 | Varadaraj et al. | 208/263 |

FOREIGN PATENT DOCUMENTS

| | | | | |
|---|---|---|---|---|
| 1435614 | * | 5/1976 | (GB) | B01F/17/00 |
| 9-208967 | * | 8/1997 | (JP) . | |
| WO 97/08270 | | 3/1997 | (WO) | C10G/19/00 |
| WO 97/08271 | | 3/1997 | (WO) | C10G/19/00 |
| WO 97/08275 | | 3/1997 | (WO) | C10G/71/00 |

OTHER PUBLICATIONS

Database DWPI on WEST, Week 200002, London, Derwent Publications Ltd., AN 1997–454165, Class H04, JP 09–208967 (Mitsubishi Jukogyo KK) abstract, 2000.*

Kalichevsky et al, "Petroleum Refining With Chemicals", Elsevier Publishing Company (1956), Month Unknown. Chapter 4, pp. 136–180.

Camp et al, "Neutralization as a Means of Controlling Corrosion of Refinery Equipment", Nat'l. Ass'n. of Corrosion Engineers, vol. 6, pp. 39–44, (Feb. 1950).

Scattergood et al, "Naphthenic Acid Corrosion, An Update of Control Methods", Corrosion, Mar. 9–13, 1987, Paper No. 197, pp. 197–1 to 197–5.

* cited by examiner

*Primary Examiner*—Daniel S. Metzmaier
(74) *Attorney, Agent, or Firm*—Gerard J. Hughes; Linda M. Scuorzo

(57) ABSTRACT

In one embodiment, the invention is related to a process for desalting crude oil that requires less wash water than conventional desalting methods. In the preferred embodiment of the invention, a chemical demulsifier formulation comprising an emulsion-breaking chemical and a solvent carrier is added to the crude oil. Wash water is then added to the crude oil until the volume of water in the oil ranges from about 0.1 to about 3 vol. %. Subsequently, the mixture of crude oil, wash water, and chemical demulsifier formulation is subjected to opposed-flow mixing. Chemical emulsion-breakers useful in the invention have a hydrophobic tail group and a hydrophilic head group. Preferably, the emulsion breaker has the formula:

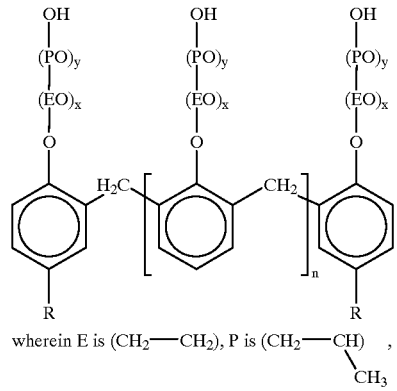

x ranges from 1 to 5, y ranges from 0 to 2, and R is an alkyl group having 4–9 carbon atoms, and n ranges from 3 to 9.

4 Claims, No Drawings

CRUDE OIL DESALTING METHOD

FIELD OF THE INVENTION

The invention is related to chemical demulsifier formulations useful in desalting heavy or waxy crude oils. The invention is also related to methods for mixing crude oil and chemical demulsifier formulations.

BACKGROUND

Crude oil contains varying amounts of inorganic salts. The presence of such salts presents difficulties during crude oil processing such as corrosion of the oil processing equipment. In order to mitigate the effects of corrosion resulting from the presence of salts, it is advantageous to reduce the salt concentration to the range of 3 to 5 ppm by weight of the crude oil. This concentration corresponds to approximately 2 pounds of inorganic salts per 1,000 barrels of crude oil.

Among the crude oil desalting methods in use today, electrostatic desalting is frequently used with crudes containing 0.5 to 2% water. Wash water is added until the crude's water content is in the range of 4 to 8 vol. %, and a chemical emulsion breaker is added so that the oil and the aqueous phases can be separated and diverted for storage or further processing. As used herein, a crude oil emulsion is a mixture of crude oil and a dispersed aqueous phase, which may be in the form of droplets stabilized by naturally occurring surface active compounds in the crude oil. Additionally, inorganic fines such as clay particles can contribute to emulsion stabilization. Dispersing added wash water into the crude increases both the average droplet number density and the droplet surface area available for binding the surface active components. Increasing droplet surface area results in a reduction in droplet coverage by the surface active components; this results in a decrease in emulsion stability and an increase in droplet coalescence.

In electrostatic separation, brine droplets in the mixture of crude oil, wash water, and chemical emulsion breaker coalesce in between electrodes located in the oil phase. The coalesced aqueous droplets then settle below the oleaginous crude oil phase. The separation may occur in a separator where an effluent brine may be removed. Treated crude containing 3–5 ppm inorganic salts is removed from the upper part of the separator. Intermediate between the oil phase and the brine phase is an undesirable "rag" layer comprising a complex mixture of oil-in-water emulsion, water-in-oil emulsion, and solids. The rag layer remains in the desalter vessel or it may be removed therefrom for storage or further processing.

Electrostatic desalting may undesirably require adding a substantial amount of wash water to the crude prior to desalting. Frequently, water must be purchased for this purpose. Another difficulty in electrostatic desalting results from the quantity and quality of effluent brine, which itself may require further processing before discharge.

Other problems associated with electrostatic desalting include crude incompatibility and the formation of undesirable emulsions. For example, electrostatic desalting becomes more difficult as a crude's concentration of asphaltenes, resins, waxes, and napthenic acids (typically found in "heavy" or "waxy" crudes) increases. Rag layers at the water-oil phase boundary also result in processing difficulties that become more serious as the emulsion becomes more stable, the rag layer increases in volume, or both.

Consequently, there is a need for a crude oil desalting method that limits the formation of undesirable emulsions, is effective with heavy and waxy crudes, that minimizes the quantity of water added prior to crude treatment, and that minimizes the quantity of effluent brine.

SUMMARY OF THE INVENTION

In one embodiment, the invention is a crude oil desalting process comprising:

(a) adding to the crude oil a chemical demulsifier formulation, the chemical demulsifier formulation being present in an amount ranging from about 1 ppm to about 1,000 ppm based on the weight of the crude oil;

(b) adding wash water to the crude oil and chemical demulsifier formulation in an amount ranging from about 0.5 vol. % to about 3.0 vol. %, provided that no wash water is added when the concentration of the brine in the crude oil is greater than about 3.0 vol. % , all vol. % being based on the total volume of the crude oil; and (c) separating the brine from the crude oil and chemical demulsifier formulation.

In another embodiment, the invention is a method for removing a brine of salt and water from a crude oil, the method comprising:

(a) mixing the crude oil under opposed-flow conditions at a temperature ranging from about 20° C. to 150° C., for a time ranging from about 1 minute to about 50 hours, and at a viscosity ranging from about 1 cP to about 250 cP in order to coalesce the brine droplets, and then (b) separating the brine from the crude oil.

DETAILED DESCRIPTION OF THE INVENTION

The invention is based on the discovery that brine droplet coalescence in crude oil can be enhanced by adding chemical emulsion breakers to the crude oil emulsion, subjecting the crude oil and brine to opposed-flow mixing, or both. Typically, brine droplets in crude oil are stabilized by a mixture of surface active components such as waxes, asphaltenes, resins, and naphthenic acids that are electrostatically bound to the droplets' surface. Such components provide an interfacial film over the brine droplet resulting in highly elastic collisions between droplets during processing, resulting in diminished droplet coalescence.

While the invention can be practiced with any crude oil containing a brine, it is preferably practiced with heavy or waxy crude oils. Heavy or waxy crude oils have one or more of the following characteristics:

(a) The crude oil has an API gravity ranging from about 5 to about 30.

(b) The crude oil has a high naphthenic acid concentration, characterized by a high "TAN" number (the TAN number represents the number of milliequivalents of potassium hydroxide required to neutralize 1 gram of crude oil).

(c) The fraction of the crude oil insoluble in n-heptane ranges from about 0.5 wt. % to about 15 wt. %.

Adding water to the crude can decrease the concentration of the surface active components on the surface of each droplet because the number of droplets is increased without increasing component concentration. It has been discovered that the amount of added water needed for desalting may be minimized by adding a chemical emulsion-breaker to the crude that is capable of displacing the surface active components from the brine droplets and then subjecting the crude oil to controlled mixing.

Chemical emulsion-breakers useful in the invention have a hydrophobic tail group and a hydrophilic head group. Preferably, the emulsion breaker has the formula:

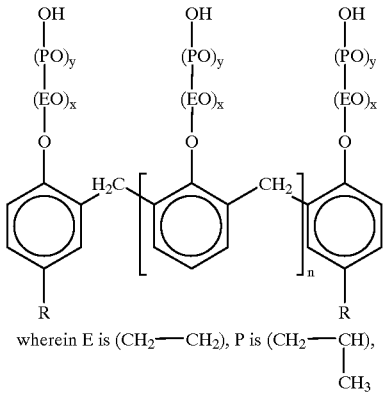

x ranges from 1 to 5, y ranges from 0 to 2, and R is an alkyl group having 4 to 9 carbon atoms, and n ranges from 3 to 9.

Preferably, the chemical emulsion-breaker is used in combination with a delivery solvent. Delivery solvents useful in the practice of this invention include a high aromaticity solvent such as toluene, xylene, and high aromatic condensates such as heavy aromatic naphtha in combination with an oxygenated solvent such as diethylene monobutyl ether or benzyl alcohol. The preferred formulation comprises about 10 wt. % to about 60 wt. % chemical emulsion breaker, about 35 wt. % to about 75 wt. % diethylene glycol mono butyl ether, and about 5 wt. % to about 15 wt. % heavy aromatic naphtha. Particularly preferred is a formulation of 45% chemical emulsion-breaker, 50 wt. % diethylene glycol mono butyl ether, and 5 wt. % heavy aromatic naphtha ("HAN").

An effective amount of the chemical emulsion-breaker-delivery solvent formulation ("chemical demulsifier formulation") is combined with the crude oil. An effective amount of the formulation is the amount necessary to displace the surface active component from the brine droplets and render the brine droplets more amenable to coalescence. The effective amount ranges from about 1 ppm to about 1,000 ppm based on the weight of the crude oil, with about 20 to about 40 ppm being preferred.

In a preferred embodiment, a crude oil and a chemical demulsifier formulation are combined and then desalted under electrostatic desalting conditions. Electrostatic desalting is known to those skilled in the art of crude oil processing. Accordingly, the crude is desalted in a vessel having electrodes at potentials ranging from about 10,000 volts to about 40,000 volts, A.C. or D.C. Voltage gradients present in the vessel range from about 500 volts per inch to about 5,000 volts per inch, preferably at a potential ranging from about 500 to about 1,000 volts per inch. Crude oil temperature ranges 220° F. to about 300° F., and residence times range upwards from about one minute, preferably from about 1 to about 60 minutes, and more preferably from about 1 to about 15 minutes.

Advantageously, mixing energy may be applied to the mixture of crude oil emulsion and chemical demulsifier formulation in order to increase brine droplet coalescence rate. When mixing is used, it is important to carefully control mixing geometry and mixing energy. The mixing may be conventional ("static") or opposed-flow, and may occur in the same vessel as electrostatic desalting.

In opposed-flow mixing, two or more counter-currents of the mixture of crude oil emulsion and chemical demulsifier impact and intermingle. Opposed propeller(or impeller) and opposed jet (or nozzle) configurations are nonlimiting examples of opposed-flow mixing.

In the opposed-propeller geometry, at least two counter-rotating propellers are immersed in the crude oil-brine mixture in order to form opposed streams within the mixture. The streams of the mixture impact and intermingle in the volume between the propellers. The propellers may be in close proximity in the same reservoir or vessel, in different regions of the same vessel, or in connected vessels or reservoirs with baffles or pipes providing conducting means for directing the streams to a region where opposed-flow mixing can occur. Parameters such as propeller spacing, propeller angular speed, and the nature of any conducting means may be determined by those skilled in the art of mixing from mixture properties such as viscosity and the desired mixing energy.

In the opposed jet geometry, the crude oil-brine mixture is separated into at least two streams. Conducting means such as pipes are used to direct the streams into an opposed-flow configuration. Accordingly, the longitudinal axes (the axes in the direction of flow) and the outlets of the pipes are oriented so that the streams impact and intermix in a region between the outlets. Preferably, two opposed pipes are employed and the angle subtended by the longitudinal axes of the pipes is about 180°. The outlets may be in the form of nozzles or jets. As in the opposed propeller geometry, parameters such as the surface area of the conduits, the flow rate of the mixture in the conduits, the size and shape of any nozzle or jet employed, and the distance between the outlets may be determined by those skilled in the art of mixing from mixture properties such as mixture viscosity and the desired mixing energy.

Importantly, when mixing is used, the mixing energy rate is controlled in a range where brine droplet coalescence occurs. Too great a mixing energy results in brine droplet break-up, and too low a mixing energy results in too few brine droplet collisions. Wile the exact range of mixing energy rate will depend, for example, on the crude oil's viscosity, mixing energy rate (mixing power) will typically range from about 0.1 hp per 1000 gallons of the mixture of crude oil emulsion and chemical demulsifier to about 3 hp per 1000 gallons, with about 0.2 hp per 1000 gallons to about 0.5 hp per 1000 gallons being the preferred range. The invention can be practiced when the mixture's temperature ranges from about 20° C. to about 150° C. and viscosity ranges from about 1 to about 250 cP. Preferably, mixture temperature ranges from about 80° C. to about 130° C. and viscosity ranges from about 1 to about 75 cP. Care should also be taken to prevent undesirable water vaporization during mixing. Water vaporization can be substantially reduced or prevented by increasing mixing pressure. Mixing times are preferably greater than about 1 minute, and more preferably range from about 1 to about 10 hours.

In some cases, it may be desirable to add a very small amount of wash water to the crude oil-brine mixture in order to optimize the coalescence rate and to extract salt that is not present in a brine phase. When used, the amount of added wash water ranges from about 0.5 to about 3.0 vol. % water based on the total volume of the crude oil, i.e., far less than is used in conventional desalting. Generally, no added wash water is used when brine is at least 3.0 vol. %.

While not wishing to be bound by any theory, it is believed that efficient brine droplet coalescence occurs when droplet collision frequency is increased and when individual droplets can be made to collide with an energy great enough to overcome the droplets' interfacial or surface tension so that a larger droplet is formed upon collision. Importantly, mixing energy should not exceed the point at which two droplets collide to produce three or more droplets. Furthermore, mixing energy should be sufficient so that the droplets do not merely collide and recoil away from each other without coalescing, as would happen in cases of insufficient mixing energy. The presence of surface or interfacially active species on the droplets' surface may result in raising or lowering the droplets' interfacial energy and interfacial elasticity. The presence of treatment solutions affecting such species may further alter the droplets' interfacial energy and interfacial film elasticity. Accordingly, mixing energy under opposed-flow conditions may vary in the practice of the invention, depending on the presence of treatment solutions or stabilizing species.

Conventional static mixing is not as effective as opposed-flow mixing in the practice of the invention because, it is believed, droplet collisions occur too infrequently and at too low an energy to cause coalescence. In conventional mixing, the neighboring droplets are at rest or move at small velocities with respect to each other, the energy of mixing being directed towards macroscopic fluid motion only.

It should be noted that opposed-flow mixing under the conditions set forth above results in some brine droplet coalescence even in cases where the crude oil-brine mixture does not contain a demulsifier or any other treatment solution. Accordingly, opposed-flow mixing can be used to remove droplets of any undesirable liquid impurity suspended in a continuous phase of a second liquid. In addition to crude oil-brine mixtures, such mixtures include crude oil products that contain process-water impurities, droplets in crude oil products resulting from the use of liquid hydrophilic catalysts, mixtures derived from the neutralization of acidic crude oil or products derived from crude oil, and mixtures derived from the caustic treatment of crude oil products and polyurea. It is advantageous to use opposed-flow mixing to enhance droplet coalescence in mixtures that do not contain a demulsifier or treatment solution when the presence of such a demulsifier or treatment solution would be incompatible with or would otherwise undesirably affect the mixture.

As set forth above, chemical demulsifier formulations and opposed-flow mixing, whether used above or in combination, are useful in improving electrostatic desalting processes. In addition, it has been discovered that such mixing and formulations, alone or in combination, are useful in improving other common forms of brine-crude oil separation, such as gravitational (settling) and centrifugal separation. In gravitational separation, for example, the increase brine droplet size resulting from the use of chemical demulsifier formulations, opposed-flow mixing, or both, shortens the retention time necessary for desalting.

The invention is further set forth in the following non-limiting examples.

EXAMPLES

Example 1

The Effect of Opposed-flow Mixing on Final Salt Concentration.

Two identical crude oils containing 0.5 vol. % water were combined with 40 ppm of a chemical demulsifier formulation of alkoxylated nonyl phenol resin. The formulation comprised 45 wt. % of a chemical emulsion breaker having the formula

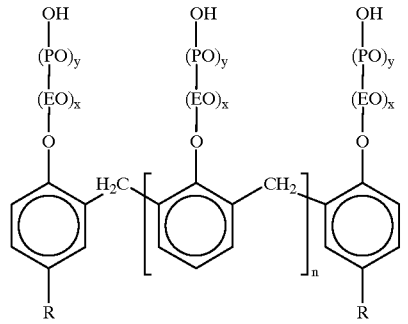

wherein E is $(CH_2-CH_2)$, P is $(CH_2-\underset{\underset{CH_3}{|}}{CH})$, n = 5, R = $C_9$, x = 4, and y = 2;

5 wt. % heavy aromatic naphtha; and 50 wt. % diethylene glycol monobutyl ether. Water was added until the total water concentration in the crude was 2.1 vol. %. One mixture (Case A) was subjected to opposed-flow mixing for 30 minutes at 80° C. and 200 psi, using two laboratory marine blade propellers configured so that the top blade's pitch was the reverse of the pitch of the bottom blade. This mixing geometry and configuration promotes axial flows in directly opposing manner that increases collision frequency. Impeller rotation was 400 rpm. This mixture was then directed to an electrostatic desalter, where the mixture was subjected to an 830 volts/inch potential at 80° C. for one hour.

The mixture of Case B was directed to the electrostatic desalter for identical treatment without opposed-flow mixing. The results are summarized in Table 1.

TABLE 1

| | Case A | Case B |
|---|---|---|
| Water Concentration in Crude | 2.1% (volume) | 2.1% (volume) |
| % Dehydration | 90 | 84 |
| Salt Concentration in lbs/1,000 barrel | | |
| Initial | 16 | 16 |
| Final | <3 | 14 |

The table shows that opposed-flow mixing with electrostatic desalting resulted in greater crude dehydration and lower salt concentration than electrostatic desalting alone.

Example 2

Opposed-flow Mixing Results in a Reduced Emulsion Rag Volume.

As discussed in the Background, an undesirable rag layer forms in electrostatic desalter between the oil phase and the water phase. In this example, two crude mixtures were prepared and combined with 40 ppm of the demulsifier formulation of Example 1.

TABLE 2

| | Case A | Case B |
|---|---|---|
| Total Water Concentration | 1.8 Vol. % | 4.5 Vol. % |
| Rag Volume | 0.2% (Vol.) | 0.5% (Vol.) |

One mixture, Case A, was subjected to opposed-flow mixing under the conditions set forth in Example 1. This mixture was then directed to an electrostatic desalter operated under conditions set forth in Example 1. The other mixture, Case B using the same starting crude oil as Case A, was electrostatically desalted under the same conditions, but without opposed-flow mixing. The results are summarized in Table 2.

Example 3

The Invention is Compatible with Crudes of Widely Varying Viscosity and Salt Concentration.

Three crudes were each combined with 40 ppm of the de-emulsifier formulation of Example 1, subjected to opposed-flow mixing as in Example 1, and subjected to electrostatic desalting also as set forth in Example 1. The results are set forth in Table 3.

TABLE 3

| | Case A | Case B | Case C |
|---|---|---|---|
| Total Vol. % $H_2O$ | 2.07 | 2.07 | 1.80 |
| Viscosity (Cp@ 80° C./1 $sec^{-1}$ | 8 | 19 | 3 |
| Salt Concentration lbs/1,000 bbl | | | |
| Initial | 16 | 7 | 113 |
| Final | <3 | <3 | 13 |

Example 4

Optimizing the Water Concentration in the Crude for Most Effective Desalting.

In this Example, 3 samples of the same crude were tested, each having an initial water concentration of 0.5 vol. %. The mixtures were combined with a demulsifier formulation, and subjected to opposed-flow mixing and electrostatic desalting as set forth in Example 1. The results are set forth in Table 4.

TABLE 4

| | Case A | Case B | Case C |
|---|---|---|---|
| Total Vol. % $H_2O$ | 0.81 | 1.35 | 2.07 |
| % Dehydration | 60 | 87 | 90 |
| Total Salt Concentration 165/1,000 bbl | | | |
| Initial | 15 | 14 | 16 |
| Final | 6 | 3 | <3 |

Example 5 and 6

Opposed-flow Mixing Results in Brine Droplet Coalescence Even When No Chemical Demulsifier Formulation is Employed.

Example 5

A homogeneous crude oil blend comprising 200 gms of San Joaquin Valley (SJV crude oil and 200 gms of Alaskan North Slope (ANS) crude oil was prepared in a 500 ml polyethylene bottle. This starting blend had a moisture content of about 1.0% and a volume mean diameter of 26.3 microns.

About 260 gms of the blend was decanted into a 300 ml autoclave equipped with two laboratory marine propeller mixers (1" blade) affixed to a common shaft. To create opposing liquid flows, the top propeller's pitch was reversed compared to the pitch of the bottom blade. This arrangement directs the top blade's liquid flow downward opposite the upward liquid flow of the bottom blade. The distance between the blades was about 2 inches. The mixture was pressurized to about 700 kPa with nitrogen to minimize vaporization of water. The blend was mixed at about 400 rpm, 80° C. at a pressure of about 1100 kPa for 30 minutes. The mixture was immediately cooled to room temperature with ice cold water surrounding the autoclave, while the mixer speed was at 200 rpm and the heater turned off. Then the mixture was decanted into a 500 ml polyethylene bottle. The resulting crude blend was found to have a moisture content of 1.0% and a volume mean particle diameter of 49.4 microns.

Example 6

The procedure in Example 5 was repeated, except that Arab Heavy crude oil was used instead of the SJV-ANS crude oil blend. The Arab Heavy crude sample was found to contain less than 0.1% of moisture. To match the about 1% moisture content of the 1:1 SJV-ANS blend, about 4 gms of deionized water was homogenized in 400 gms of Arab Heavy in a laboratory blender for 5 minutes at low speed. The resulting crude (Crude B) was found to have a moisture content of about 1% and a volume mean diameter of about 54 microns.

240 grams of crude-water mixture were subjected to the mixing procedure of Example 5, except the mixer speed was 100 rpm and the mixing time was 3 hours.

The resulting crude was found to have a moisture content of about 1% and a volume mean diameter of about 77 microns.

What is claimed is:

1. A method for removing a brine of salt and water from a crude oil, the method comprising:

(a) adding to the crude oil a chemical demulsifier formulation, the chemical demulsifier formulation being present in an amount ranging from about 1 ppm to about 1,000 ppm based on the weight of the crude oil;

(b) adding wash water to the crude oil and chemical demulsifier formulation in an amount ranging from about 0.5 vol. % to about 3.0 vol. %, provided that no wash water is added when the concentration of the brine in the crude oil is greater than about 3.0 vol. % being based on the total volume of the crude oil; and (c) separating the brine from the crude oil and chemical demulsifier formulation under electrostatic desalting conditions at a temperature ranging from about 220° F. to about 300° F., at an electrostatic potential ranging from about 500 to about 5000 volts per inch and for a time ranging from about 1 to about 30 minutes wherein the chemical demulsifier formulation contains about 35 wt. % to about 75 wt. % of at least one delivery solvent selected from the group consisting of dipropylene monobutyl ether, isoparaffinic solvent, cycloparaffinic solvent, diethylene glycol monobutyl ether, benzyl alcohol; about 5 wt. % to about 15 wt. of heavy aromatic naphtha; and a chemical emulsion breaker present in an amount ranging from about 10 wt. % to about 60 wt. % and having a formula:

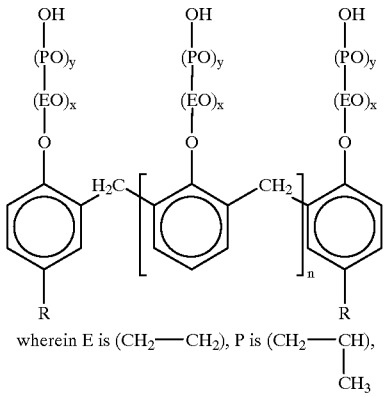

x ranges from 1 to 5, y ranges from 0 to 2, R is an alkyl group having 4 to 9 carbon atoms, and n ranges from 3 to 9;

all wt. % being based on the weight of the chemical demulsifier formulation.

2. The method of claim 1 further comprising mixing the crude oil and chemical demulsifier formulation under opposed-flow conditions at a temperature ranging from about 20° C. to 150° C., a viscosity ranging from about 1 cP to about 250 cP, and for a time ranging of at least about 1 minute.

3. The method of claim 2 wherein the mixing power under opposed-flow conditions ranges from about 0.1 hp per 1000 gallons to about 3 hp per 1000 gallons.

4. The method of claim 3 the crude oil is a heavy or waxy crude oil.

* * * * *